US005526672A

United States Patent [19]

Cain et al.

[11] Patent Number: 5,526,672

[45] Date of Patent: Jun. 18, 1996

[54] PRESS BRAKE BACKGAGE

[75] Inventors: Larry P. Cain, Clinton; Theodore L. Bauer, North Canton; Charles A. Pozzini, Rootstown, all of Ohio

[73] Assignee: InterBold, North Canton, Ohio

[21] Appl. No.: 504,629

[22] Filed: Jul. 20, 1995

[51] Int. Cl.[6] ..... B21D 11/22

[52] U.S. Cl. ..... 72/461; 72/389.3; 83/467.1; 83/468.1

[58] Field of Search ..... 72/461, 389, 386; 83/467.1, 468.1, 468.2, 468.7

[56] References Cited

U.S. PATENT DOCUMENTS 3,812,695 5/1974 Roch ..... 72/461
3,826,119 7/1974 Marotto ..... 72/461
4,411,150 10/1983 Kein et al. ..... 72/461
4,700,937 10/1987 Naylor ..... 72/461

*Primary Examiner*—David Jones
*Attorney, Agent, or Firm*—Ralph E. Jocke

[57] ABSTRACT

A backgage (22) for use in conjunction with a press brake (10), includes an arm (24) movable in three axial directions (R, X, Z) by a drive (26). A gage block (54) is supported on the arm and includes a gage finger assembly (72) including a movable finger (76). A projecting member (94) engages a recess (100) in the finger to releasably latch the finger in a first position. Excessive force encountered by the finger during a collision with an obstruction unlatches the finger and enables it to move to avoid damage.

37 Claims, 5 Drawing Sheets

PRESS BRAKE BACKGAGE

TECHNICAL FIELD

This invention relates to metal-forming devices. Specifically this invention relates to a backgage for use in conjunction with a press brake which has gage fingers that minimize the risk of damage in the event of a collision between the backgage and the pans formed or tooling used in the press brake.

BACKGROUND ART

Press brakes are well known in the prior art. Press brakes are most commonly used to form pans from sheet metal. Press brakes commonly have a ram which is movable up and down relative to a stationary bed. Mating dies which are mounted to the ram and bed enable sheet metal parts to be bent to a desired configuration by lowering the ram and deforming the metal between the dies. Press brakes often have a wide ram which enables multiple sets of dies to be mounted in different longitudinal locations. These different die sets perform different types of metal deformation. This enables an individual to form a pan with several different types of bends on a single press brake by moving the piece from one die set to another.

Backgages are used in conjunction with press brakes to position a part that is being formed. A backgage may include stops or "fingers" which limit how far a piece of sheet metal is extended inwardly between the bed and the ram. The backgage is positioned during tooling setup operations so that when the metal to be formed is extended through the tooling and abuts the fingers of the backgage, the desired pan configuration is achieved when the ram is lowered to form the pan. The proper positioning of a backgage is critical because incorrect positioning of the backgage results in parts that are out of tolerance and which often must be scrapped.

It is common in metal-forming operations using press brakes to have several forming operations of a similar type performed on the same part. Although some of these operations may be performed with the same tooling, it is not uncommon for the position of the fingers of the backgage to be different for each operation. In the manufacture of such parts, it is possible to have several sets of identical tooling spaced longitudinally along the ram and bed of the press brake, each of which has a different stop position. While this approach works satisfactorily, it requires multiple sets of tooling which adds expense both from an initial cost and a set-up standpoint.

An alternative approach to the manufacture of parts which require similar forming operations but different backgage positions, is the use of a movable backgage. Programmable backgage positioning devices are available from Cincinnati Inc. and others. A programmable backgage often enables an operator to perform several operations with the same tooling. The programmable backgage is programmed to move to the fingers of the backgage to the desired positions for each of the forming operations. As long as the press brake operator performs the operations in the programmed sequence, the parts will be properly formed.

A further advantage associated with the use of programmable backgages is that they greatly increase the number of forming operations that may be performed on a single press brake without having to change the setup. Die sets which perform different types of bends or forming operations may be positioned longitudinally along the ram and bed of the press brake. The operator moves the work piece from one tooling position to another as the different forming operations are performed in the sequence of part production. The backgage is programmed to move the fingers to the longitudinal position along the bed of the press brake where the operator will perform the next operation on the part. As a result the fingers are accurately and automatically positioned. Further, the movement of the fingers to a new position adjacent to a new die set serves to remind the press operator of the next operation to be performed.

While programmable backgages are very useful, they also present certain disadvantages. One common disadvantage is that when the backgage moves the fingers automatically back and forth parallel to the ram and bed, it may strike an obstruction. Such obstructions may include parts or tooling that are positioned between the prior location of the backgage and the new location to which the backgage is moving. When the backgage strikes an obstruction, damage to the backgage or the item hit will commonly occur. In the case of the backgage, the items most commonly damaged are the gage fingers which include the surfaces used to position the inward extending face of the part. When a collision occurs, the gage fingers may be bent or broken. Violent collisions may cause damage to the structure of the drive which moves the backgage. In either event, the gage fingers and perhaps other components must be replaced and the press brake must be set up again after the repairs are made. This is a very expensive process both in terms of costs to repair and machine downtime.

Programmable backgages may also be run under manual control. Manual control is used most often during set-up to determine the desired positions for the gage fingers of the backgage to achieve the desired part dimensions. Once the optimum positions are found the positions are stored in the memory of the machine. Sometimes when the machine is in the set-up mode and is being manually moved, the set-up person will inadvertently move the backgage so that the gage fingers hit an obstruction. When this occurs, damage to the gage fingers and other components are likely to result. After the repairs are made, the set-up work done prior to the collision has to be repeated.

Thus there exists a need for a backgage that reduces the risk of damage as the result of collisions between the backgage fingers and obstructions. There further exists a need for a backgage that may be readily put back in service after a collision without the need for extensive set-up activities.

DISCLOSURE OF INVENTION

It is an object of the present invention to provide a backgage for a press brake.

It is a further object of the present invention to provide a backgage for a press brake that minimizes the damage as the result of a collision between the backgage and an obstruction.

It is a further object of the present invention to provide a backgage for a press brake that may be quickly and readily returned to service after a collision with an obstruction.

It is a further object of the present invention to provide a backgage for a press brake that reduces repeat set-up time after a collision between the backgage and an obstruction.

It is a further object of the present invention to provide a backgage for a press brake that includes deformable fingers that may be readily returned to their original configuration after a collision.

It is a further object of the present invention to provide a backgage for a press brake having gage fingers that are held in a precise position, but which are displaceable in response to a force that might otherwise cause damage to the gage fingers.

It is a further object of the present invention to provide a backgage for a press brake that provides a plurality of part-engaging surfaces.

It is a further object of the present invention to provide a backgage for a press brake that is economical, easy to use, and which reduces set-up time.

Further objects of the present invention will be made apparent in the following Best Mode for Carrying Out Invention and the appended Claims.

The foregoing objects are accomplished in a preferred embodiment of the invention by a press brake backgage that includes a drive. The drive operates to move at least one arm selectively along any combination of three axial directions. The arm has supported thereon a gage finger. The gage finger includes a part engaging face at its first longitudinal end. The part engaging face engages an inward extending face of parts that are formed in the press brake.

The backgage further includes a mounting member which is supported by the arm and is connected to the gage finger. The mounting member enables the gage finger to move relative to the arm in at least one axial direction. A disengageable latch holds the finger in a first position. In the first position the part-engaging surface extends to the desired location for the pans to be formed on the press brake.

Forces which are normally encountered during the forming process do not disturb the position of the finger. However, if the gage finger is subjected to a force in excess of what is normally encountered in forming operations, the disengageable latch unlatches and enables the gage finger to move in the direction of the force. In the preferred form of the invention the gage finger moves in a rotational direction about the mounting member so that it is enabled to swing out of the way of an obstruction. The latch unlatches before a potentially damaging force is applied as a result of a collision. This minimizes the risk of damage to the gage finger and to the obstruction, which is typically an item of tooling or a part.

Once displaced from the first position, the gage finger may be readily returned to the first position and latched. As a result, the backgage may be returned to service without the need for additional set-up or repair.

In the preferred embodiment, the gage finger pivots about the mounting member, which is a pin. However in other embodiments, other types of mounting members may be used including those that do not involve a fixed point of rotation such as a detent. Further, other embodiments may employ mounting members such as rails or tracks which enable movement of the finger thereon in the direction of the undesirable force resulting from a collision.

BEST MODE FOR CARRYING OUT INVENTION

Figure 1:
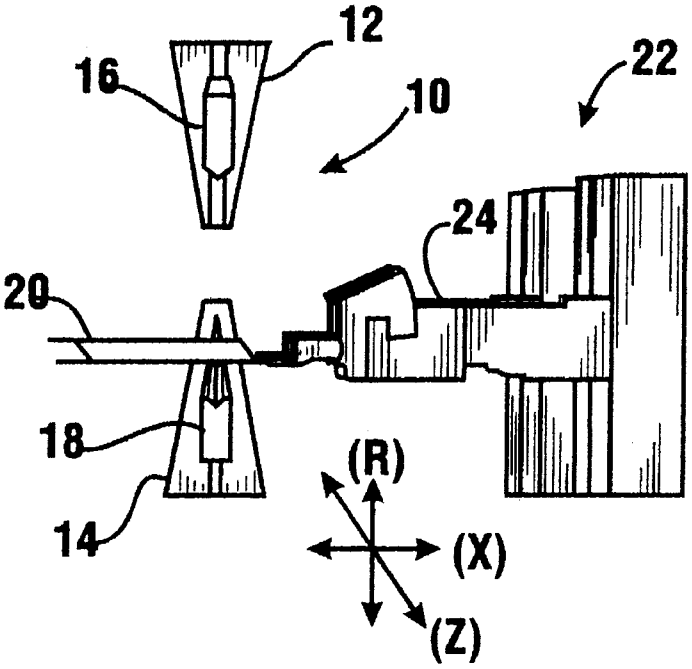
FIG. 1 is an isometric side view of a press brake and backgage.

Referring now to the drawings, and particularly to FIG. 1, there is shown therein a press brake generally indicated 10. The press brake includes a ram 12 and a bed 14. The ram 12 is selectively movable up and down with respect to the bed under control of an operator. Mating dies 16 and 18 are mounted on the ram and bed respectively. A metal piece 20 is formed by positioning it between the dies and lowering the ram. The metal piece 20 is thereby bent to a desired configuration.

Figure 2:
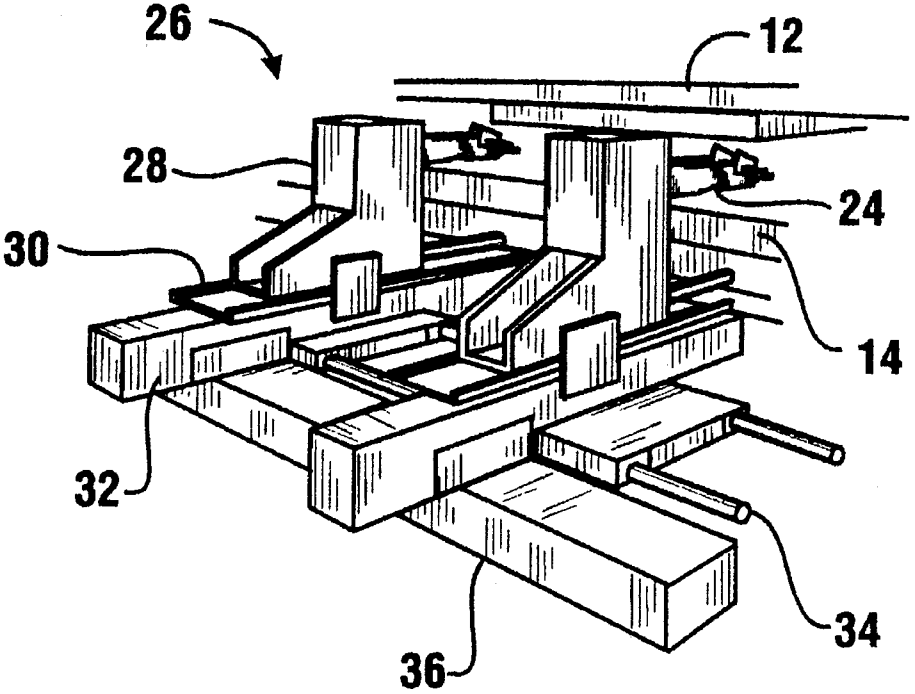
FIG. 2 is an isometric rear view of the press brake and backgage.

A backgage generally indicated 22 is shown in FIGS. 1 and 2. The backgage includes a pair of horizontally extending arms 24. Each arm 24 is selectively movable relative to the bed 14 of the press brake in three axial directions. These are the vertical or (R) direction, the horizontal or (X) direction and the longitudinally or (Z) direction as shown in FIG. 1. The arm is selectively movable in all of these directions to enable selective movement of the arm to any position within a three dimensional field.

The arms 24 are each individually movable by an associated drive 26. In the preferred embodiment of the invention each drive includes a plurality of hydraulic actuators. Each arm is selectively movable in the "up and down" or (R) axial direction on a head 28. Further, the head itself is movable in the "in and out" or (X) axial direction on rails 30 which are supported on a carriage 32. The carriage is movable in the longitudinal or (Z) direction parallel to the bed 14 on rails 34. Rails 34 are supported on a foundation 36.

Fluid power devices such as cylinders, rotary actuators and hydraulic power units move the components of the drive under the control of a processor. The processor has an associated memory. This enables the arms 24 of the backgage to be positioned by the drive 26 to any desired position in the three-dimensional field.

Figure 3:
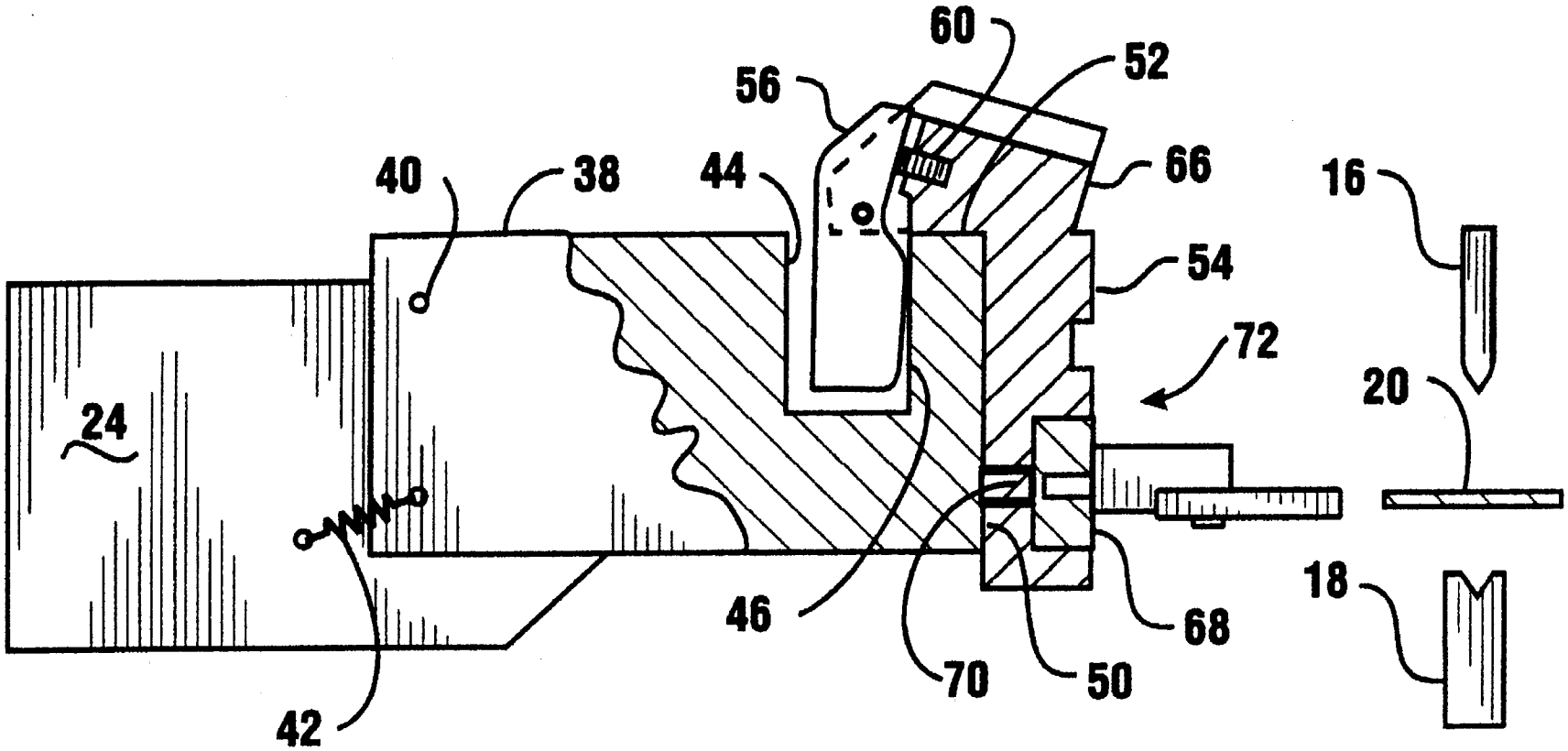
FIG. 3 is a partially sectioned side view of the backgage arm and tooling associated with a press brake.

As shown in FIG. 3, each arm 24 includes a gage bar 38. Each gage bar 38 is rotatable in the upward or counter-clockwise direction from the position shown in FIG. 3 about a pivot 40. Gage bar 38 is held in its downward position by a strong spring 42. Gage bar 38 includes a longitudinally extending recess 44 therethrough. Recess 44 is bounded by a from wall 46.

Figure 4:
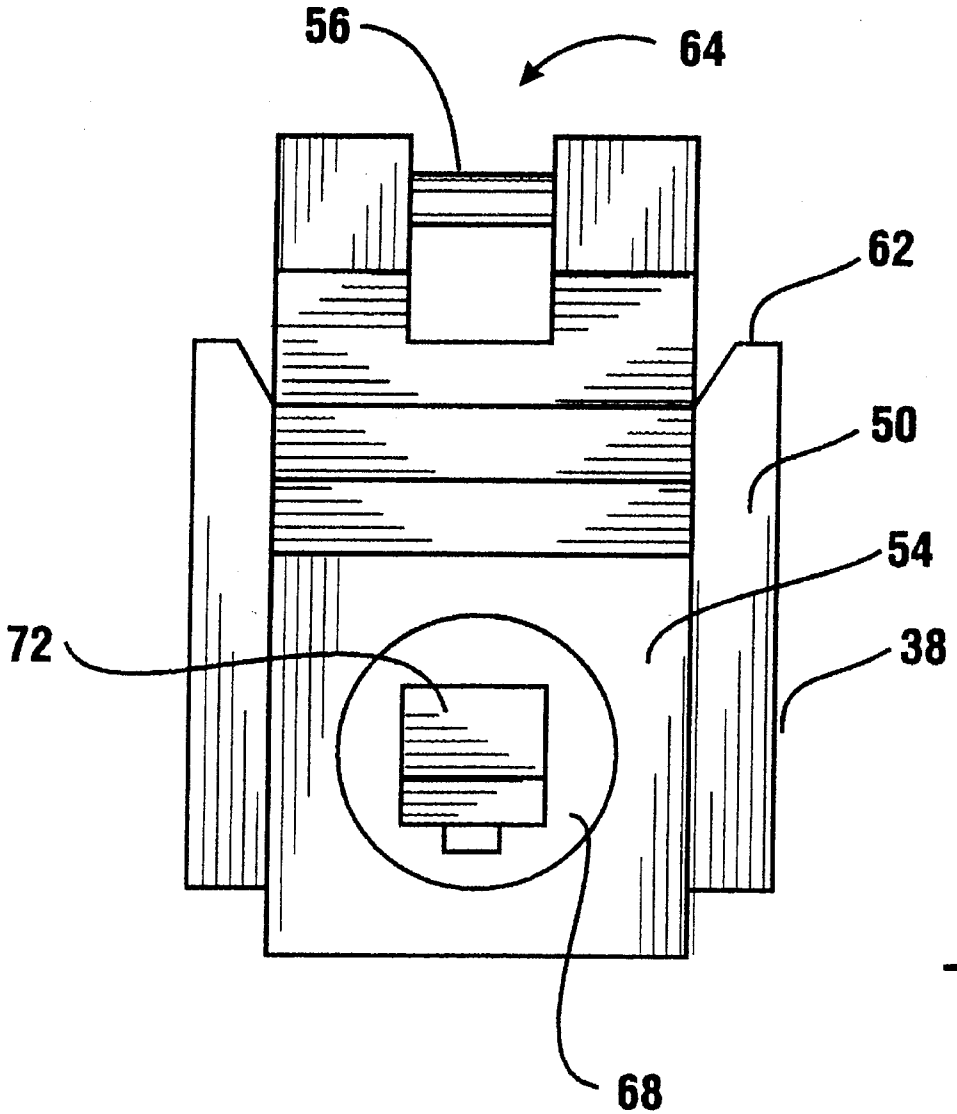
FIG. 4 is a front view of the gage finger, gage block and arm of the backgage.

Each gage bar 38 further includes a gage face 50 and a top wall 52. Gage face 50 and top wall 52 support a gage block 54 (see FIG. 3) which serves as a base. Gage block 54 has pivotally mounted thereto a clamp 56. Clamp 56 extends into longitudinal recess 44 in nested relation. A compression spring 60 biases clamp 56 in the counter-clockwise direction as shown in FIG. 3. The biasing force holds the gage block in firm engagement with gage face 50 of gage bar 38. As shown in FIG. 4, top wall 52 includes tapered ears 62 which serve to hold gage block 54 in centered relation on gage bar 38.

Gage block 54 includes a central recess 64 along its top. Recess 64 enables grasping of the top of clamp 56 with a conventional tool made for this purpose known to those skilled in the art. The tool also engages the front angled surface 66 of the gage block 54 at the same time as the top of clamp 56 is moved forward. This enables gage block 54 to be disengaged from the arm and removed from the press brake. This avoids the need for an operator or set-up person to extend their body between the ram and the bed of the press brake when installing or removing the gage block 54. This minimizes the risk of injuries.

Gage block 54 further has mounted therein an adjusting collar 68. Adjusting collar 68 is generally cylindrical and includes a shaft portion 70 extending rearward therefrom. Adjusting collar 68 is selectively rotatably positionable in gage block 54 and locked in the desired orientation by fasteners (not shown).

Figure 7:
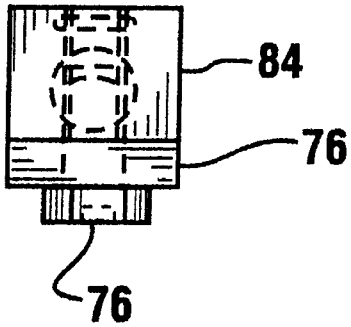
FIG. 7 is a front view of the gage finger assembly shown in FIG. 5.
Figure 5:
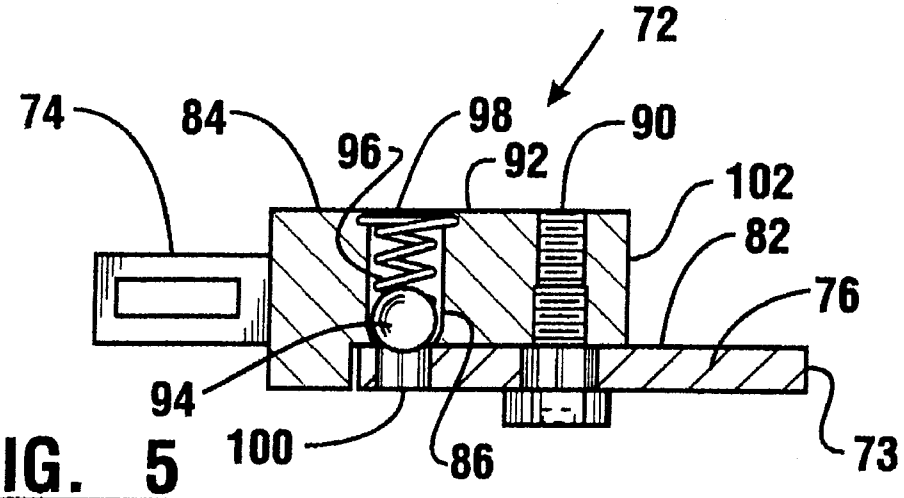
FIG. 5 is a side sectional view of a gage finger assembly.
Figure 6:
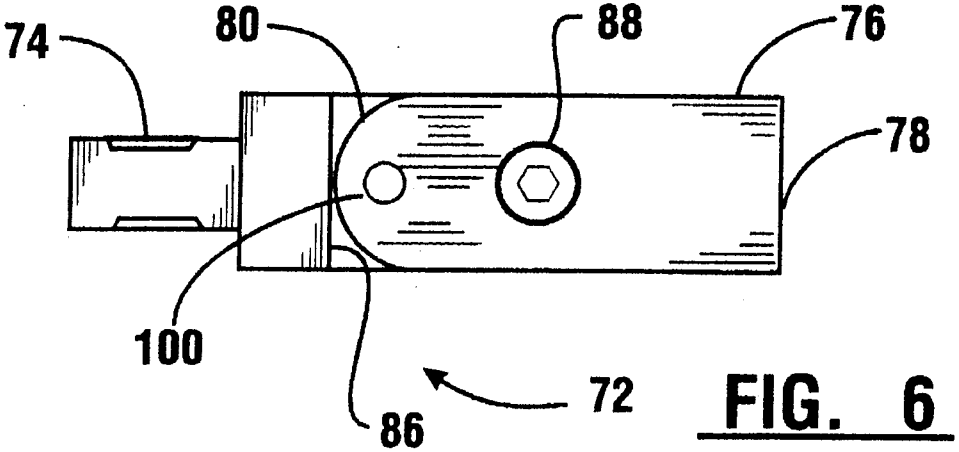
FIG. 6 is a bottom view of the gage finger assembly shown in FIG. 5.
Figure 8:
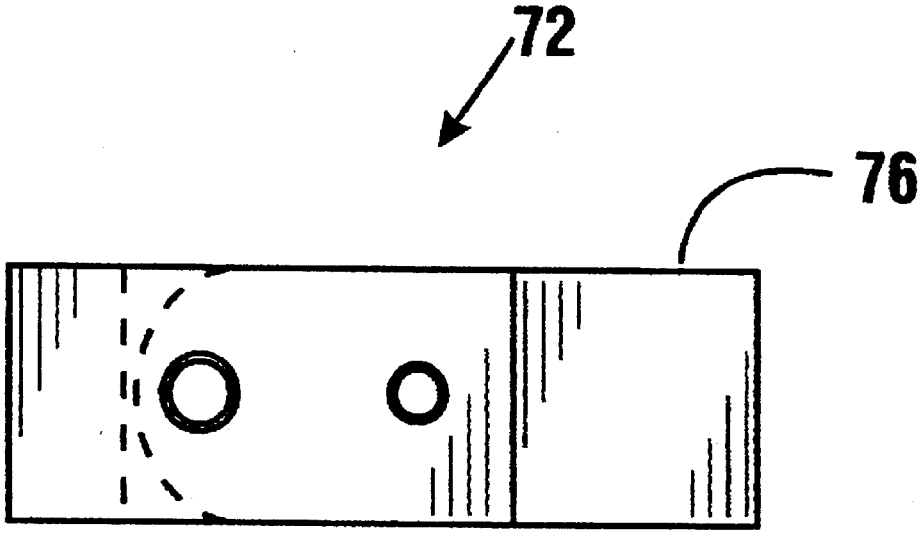
FIG. 8 is a partial top view of the gage finger assembly shown in FIG. 5.

The gage block includes a gage finger assembly 72 that extends longitudinally outward from adjusting collar 68. As best shown in FIGS. 5 through 7, assembly 72 includes a shank portion 74. Shank portion 74 extends into adjusting collar 68 and is fastened therein by a fastener (not shown).

Assembly 72 further includes a movable finger 76. Finger 76 includes a part-engaging face 78 at a first longitudinal end. Finger 76 further includes an arcuate back face 80 at a longitudinal end opposite part engaging face 78. Finger 76 also has an upward facing planar support surface 82.

Gage finger assembly 72 also includes a finger base 84. Finger base 84 extends outward from shank portion 74. Finger base 84 includes a base surface 86 which is a generally planar surface that extends in abutting engagement with a proximal portion of support surface 82 of finger 76. Finger 76 is held to finger base 84 by a pin type mounting member 88. In the preferred form of the invention, mounting member 88 is a shoulder bolt which is threaded into an opening in finger base 84. The threaded connection enables the finger to be disengageable from the base. Finger 76 is rotatable about an axis 90 of the mounting member 88.

Finger base 84 also includes a bore 92 which terminates at an opening in base surface 86. As shown in FIG. 5, bore 92 has a diameter which is somewhat larger throughout its length than the opening through base surface 86. A projecting member 94, which in the preferred embodiment is a ball, is positioned in bore 92. Projecting member 94 is sized to extend partially through the opening in base surface 86, but is prevented from passing completely therethrough. Projecting member 94 is biased towards the opening in base surface 86 by a compression spring 96. Compression spring 96 is held in bore 92 by a snap ring 98 which nests in an annular recess adjacent to the top of bore 92.

Finger 76 includes a recess 100 in support surface 82 adjacent to back face 80. In the preferred embodiment of the invention, recess 100 is a portion of a hole that extends all the way through finger 76. In other embodiments a depression in the surface may be used. The opening in base surface 86 to bore 92 is in alignment with recess 100 when finger 76 is in a first position as shown in FIG. 5. In this position of the finger 76, the projecting member 94 engages recess 100 in the finger. This construction forms a disengageable latch which holds finger 76 in the first position with its part-engaging face extending outward and in alignment with arm 24. The force of the projecting member 94 engaging recess 100 prevents finger 76 from rotating about mounting member 88 despite the application of forces to the finger encountered during normal use. However, if an abnormally high force in the longitudinal direction is applied in the area of the part engaging face 78 of finger 76, the force will dislodge projecting member 94 from the recess 100, and finger 76 will rotate as later explained.

Finger base 84 includes a further part-engaging face 102. Further part-engaging face 102 extends generally parallel with face 78 of finger 76 when the finger is in the first position. Face 102 is vertically disposed from face 78 for reasons that are later discussed in detail.

The finger base 84 also includes a clearance face 104 at the lower side thereof as best shown in FIG. 6. Clearance face 104 is closely adjacent to the back face 80 of finger 76. Finger 76 is rotatable about mounting member 88 through a first angle of more than 90 degrees (in fact approximately 130 degrees) without interference between finger 76 and clearance face 104. This enables finger 76 to rotate away from an obstruction during a collision.

In operation, the press brake backgage of the present invention may be used in the conventional manner for positioning work pieces. The part-engaging face 78 of each finger 76 is positioned in the first position as shown in FIGS. 5 through 8 and provides a point of reference for the edges of parts that are formed in the press brake. Generally both arms of the back gage will be used at the same time so as to accurately position an edge of the part being formed in two locations. Alternatively in some situations, the further part-engaging surface 102 may be used as a reference surface. In such situations the support surface 82 of finger 76 may be used as to provide support for the part being formed.

Figure 9:
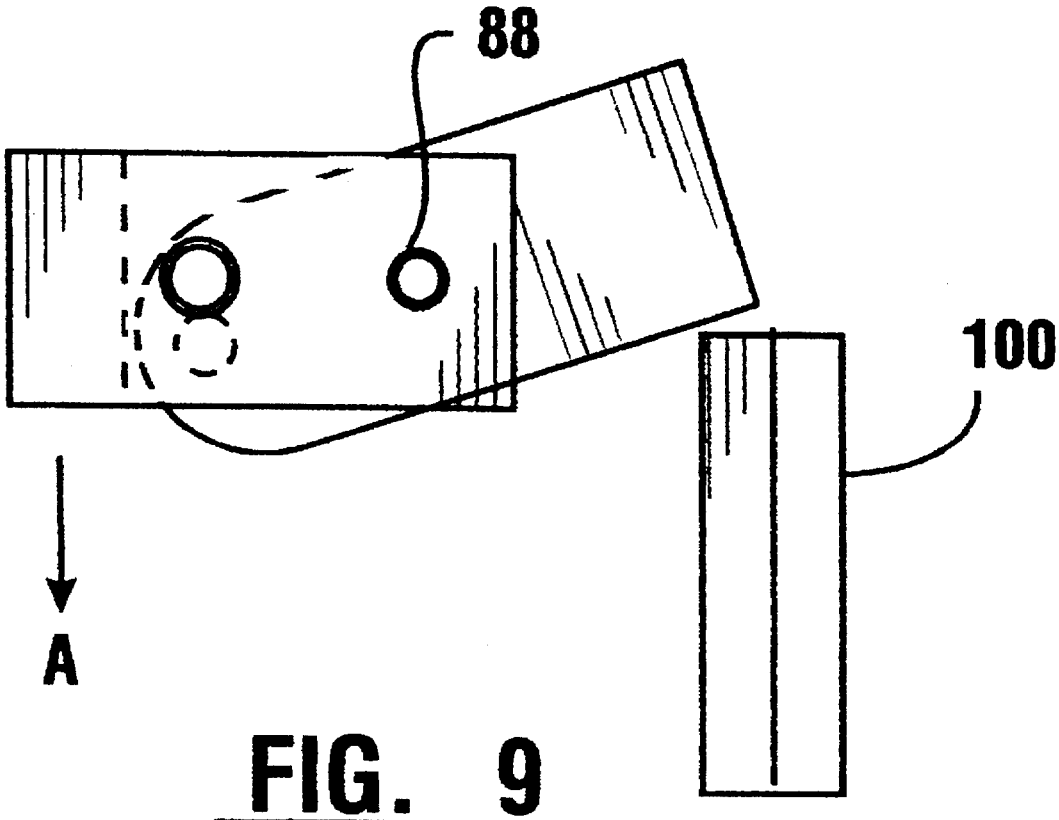
FIG. 9 is a top view of the gage finger assembly shown in FIG. 8 with the finger displaced due to a collision with an obstruction.

When the arm is moved in the direction of arrow A as shown in FIG. 9, and the finger assembly encounters an obstruction 106 (such as lower die 18), a large force will act on the finger 76 in a direction opposed to the direction of arm movement. When this occurs, the disengageable latch formed by the projecting member and mating recess 100 will disengage, enabling finger 76 to rotate about the axis of mounting member 88. The press operator may either observe the collision and stop the movement of the arm of the backgage, or the backgage may continue to move until finger 76 has sufficiently rotated so that it may pass the obstruction. In either event no damage is done to the finger, the obstruction, the arm or the drive. The finger 76 may be quickly "popped" back into the first position and operation of the press and backgage recommenced.

This construction is highly desirable because most inadvertent collisions occur with the outer-most extending portion of the backgage finger assembly. Through the use of the present invention, such collisions do not cause any damage to the backgage, and once the finger is returned to its first position, no additional set up or remedial action is required. The force required to disengage the latch is sufficiently high so that the finger 76 may withstand forces normally encountered during forming operations without displacement. However, in the event of an excessive force, the latch will enable the finger to move from the first position to avoid damage.

In the preferred embodiment of the invention shown in FIGS. 5 through 7, the clearance face 104 of the base is positioned in closely space relation with the back face 80 of the finger 76. This provides clearance for the rotation of the finger through a first angle of more than 90 degrees without interference. This enables finger 76 to swing out of the way from an obstacle. In other embodiments, such a wide angle of movement for the finger portion may not be necessary.

In the preferred embodiment shown, the mounting member for the finger is in the nature of a pin or shaft. In other embodiments other types of mounting members may be used. Examples of such other equivalent members may include rails or guides which enable the finger to move in a direction opposite to the excessive collision force. Other embodiments may not require a rigid connection between the finger and the base. In such embodiments the mounting member may include structures such as a hemispherical projection biased into a recess in the base in a manner similar to that in which the projecting member is biased to engage this finger of the embodiment shown. In such an embodiment, the finger would be biased to maintain its position under normal circumstances, but when subject to excessive force in any direction it would move in the direction of the applied force. Such alternative embodiments are within the capabilities of those skilled in the art based on the teachings of the present application.

In other embodiments of the invention, the projecting member and recess of the preferred embodiment may have equivalent structures substituted therefore. Such equivalent structures include other forms of detachable latching mechanisms or detent mechanisms which will hold the finger in a desired position, but then release in response to an excessive force. Such equivalent disengageable latching structures may also include those that rely on frictional engagement to provide unlatching.

Thus the new press brake backgage of the present invention achieves the above-stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations given are by way of examples, and the invention is not limited to the exact details shown and described. Further, in the following claims any features of the invention which are described as a means for performing a function are to be construed as encompassing any means capable of performing the function and are not limited to the particular means shown in the specification or equivalents.

Having described the features, discoveries and principles of the invention, the manner in which it is operated and utilized, and the advantages and useful results attained; the new and useful structures, devices, elements, arrangements, parts, combinations, systems, equipment, operations, methods and relationships are set forth in the appended claims.

We claim:

1. A press brake backgage comprising:

an arm;

a drive, wherein said drive moves said arm in at least one axial direction;

a finger, said finger including a part-engaging face at a first longitudinal end;

a mounting member supported by said arm and operatively connected with said finger, wherein said mounting member enables movement of said finger relative to said arm in a direction opposed of said first direction; and a disengageable latch operatively connected with said finger, wherein said latch is engageable to hold said finger in a first position, and wherein said latch unlatches responsive to a force acting on said finger in said opposed direction wherein said finger is enabled to move in said opposed direction, whereby damage is avoided when said finger encounters an obstacle during movement of said arm.

2. The backgage according to claim 1 wherein said mounting member comprises a pin member and wherein said finger is rotatable about an axis of said pin member.

3. The backgage according to claim 1 wherein said latch comprises a projecting member and a spring for biasing said projecting member, whereby said projecting member holds said finger in the first position.

4. The backgage according to claim 3 wherein said latch further comprises a recess, wherein said projecting member extends in said recess when said finger is in the first position.

5. The backgage according to claim 3 wherein said face and said projecting member are disposed on opposed longitudinal sides of said mounting member.

6. The backgage according to claim 1 wherein said finger comprises a back face at an opposed longitudinal end from said part engaging face, and said backgage further comprises a clearance face supported by said arm, said clearance face in adjacent relation to said back face, wherein movement of said finger is limited by engagement of said finger and said clearance face.

7. The backgage according to claim 1 and further comprising a base in intermediate relation between said arm and said finger, said base including a further part-engaging face supported thereon, said further part-engaging face disposed vertically from said part-engaging face of said finger.

8. The backgage according to claim 7 wherein said further part-engaging face supported on said base extends generally parallel with said part-engaging face of said finger.

9. The backgage according to claim 1 and further comprising a base supported on said arm, and wherein said finger is movably mounted in supported relation on said base, and wherein said base comprises a base surface, wherein said base surface extends generally planar horizontally, and wherein said finger comprises a generally planar support surface, and wherein said finger is movable with said support surface in engagement with said base surface.

10. The backgage according to claim 9 wherein said mounting member extends between said support surface and said base surface.

11. The backgage according to claim 9 wherein said finger is rotatable about an axis of said mounting member and wherein said mounting member extends between said finger and said base.

12. The backgage according to claim 11 wherein said latch comprises a projecting member, a spring biasing said projecting member, and a recess accepting said projecting member therein in releasable relation when said finger is in the first position.

13. The backgage according to claim 12 wherein said projecting member extends from said base surface, and wherein said recess extends in said support surface.

14. The backgage according to claim 6 wherein said finger is rotatable about an axis of said mounting member, and wherein said back face is arcuate, and wherein said finger is enabled to rotatably move relative to said axis through a first angle without engagement with said clearance face.

15. The backgage according to claim 11, wherein said mounting member is disengageable from said base.

16. The backgage according to claim 9, wherein said part-engaging face is a generally vertically extending surface, and wherein said base comprises a finger base, said finger base including said base surface and wherein said base further comprises a vertically extending further part-engaging face, said further part engaging face horizontally disposed from said first part-engaging face of said finger when said finger is in the first position.

17. The backgage according to claim 9, wherein said base surface includes a pair of spaced openings therein, said spaced openings each accepting one of said mounting member and said projecting member therein.

18. The backgage according to claim 12 wherein said base includes a finger base disposed vertically from said finger, said finger base including a bore therethrough, said bore including a bore opening through said base surface, wherein said projecting member is positioned in said bore, and wherein said bore opening is sized to prevent passage of said projecting member entirely through said bore opening.

19. A press brake backgage comprising:

an arm;

means for moving said arm in at least one axial direction;

a finger, said finger including at least one part-engaging surface;

means for movably mounting said finger in supported relation with said arm wherein said finger is movable in a direction opposed of said first direction; and releasable latching means for latching said finger in a first position and for unlatching responsive to a force acting on said finger in an opposed direction.

20. A press brake backgage comprising:

an arm;

a drive wherein said drive moves said arm;

a finger in supported connection with said arm, said finger including at least one part engaging face;

a disengageable latch in operative connection with said finger wherein said latch is engageable to hold said finger in a first position, and wherein said latch is disengageable responsive to a collision force acting on said finger, wherein said finger is enabled to move from said first position upon disengagement of said latch.

21. A gage finger assembly for a press brake backgage comprising:

a base;

a finger, said finger including a part engaging face;

a disengageable latch operatively connecting said finger and said base, wherein said latch is engageable to hold said finger in a first position, and wherein said latch unlatches responsive to a collision force acting on said finger, whereby said finger is enabled to move to minimize damage as a result of a collision.

22. A gage finger assembly according to claim 21 and further comprising a mounting member movably mounting said finger on said base.

23. The gage finger assembly according to claim 21 wherein said finger is movable relative to said base in both a first direction and an opposed direction, and wherein said disengageable latch enables movement of said finger in either of said directions from said first position responsive a force acting in either of said directions.

24. The gage finger assembly according to claim 22 wherein said finger is rotatable about said mounting member.

25. The gage finger assembly according to claim 21 wherein said latch comprises a projecting member and a spring for biasing said projecting member, whereby said projecting member holds said finger in the first position.

26. The gage finger assembly according to claim 25 wherein said latch further comprises a recess, and wherein said projecting member engages said recess when said finger is in the first position.

27. The gage finger assembly according to claim 25 and further comprising a mounting member movably mounting said finger on said base, and wherein said part engaging face and said projecting member are on opposed sides of said mounting member.

28. The gage finger assembly according to claim 22 wherein said base includes a generally planar base surface, and wherein said finger includes a generally planar support surface, and wherein said mounting member holds said support surface adjacent said base surface.

29. The gage finger assembly according to claim 22 wherein said mounting member holds said finger and said base in attached relation, and wherein said mounting member is disengageable to enable said finger to be disconnected from said base.

30. The gage finger assembly according to claim 21 wherein said latch once disengaged, is reengaged by movement of said finger to the first position.

31. A method of minimizing damage resulting from a collision between a work piece positioning finger supported on a backgage and items in a press brake, comprising the steps of:

movably mounting a part engaging finger in supported relation with a backgage, wherein said finger is movable relative to said backgage;

holding said finger in a first position relative to said backgage with a disengageable latch; and disengaging said latch to enable movement of said finger responsive to a collision force acting on said finger.

32. The method according to claim 31 and further comprising the steps of returning said finger to said first position and re-engaging said latch.

33. The method according to claim 31 wherein said holding step comprises engaging a spring biased projecting member in a recess, whereby said finger is held in the first position.

34. The method according to claim 31 wherein said finger is rotatably mounted about a generally vertically extending axis, and wherein said finger moves in a first rotational direction about said axis in response to said collision force.

35. The method according to claim 31 wherein said finger moves responsive to said collision force in a generally longitudinal direction, and further comprising the step of moving said finger on the backgage in the generally longitudinal direction.

36. The method according to claim 31 wherein said finger comprises a part engaging face at a first longitudinal end, a recess adjacent a second longitudinal end and a mounting member intermediate of said ends, wherein said finger is rotationally movable about said mounting member, and wherein said holding step comprises engaging a projecting member in said recess, and wherein said unlatching step comprises displacing said projecting member from said recess responsive to said collision force.

37. The method according to claim 31 and further comprising the steps of moving said finger in a longitudinal direction on said backgage to engage an obstruction thereby causing said collision force, and moving said finger in an opposed longitudinal direction relative to said backgage and transversely away from said obstruction responsive to said collision force.

* * * * *